United States Patent [19]

Stein et al.

[11] Patent Number: 4,572,267

[45] Date of Patent: Feb. 25, 1986

[54] VENETIAN BLIND WITH SELECTIVE TILT LIMITING

[75] Inventors: Carl Stein, New York, N.Y.; Harold M. Lewis, Montgomery, Pa.

[73] Assignee: Marathon Manufacturing Company, Montgomery, Pa.

[21] Appl. No.: 610,481

[22] Filed: May 15, 1984

[51] Int. Cl.[4] ..... E06B 9/26

[52] U.S. Cl. ..... 160/176 R; 160/236

[58] Field of Search ..... 160/176, 177, 175, 174, 160/168 R, 166 R, 166 A

[56] References Cited

U.S. PATENT DOCUMENTS

| | | | |
|---|---|---|---|
| 1,470,044 | 10/1923 | Allen | 160/175 |
| 2,914,122 | 11/1959 | Pinto | 160/166 R X |
| 3,581,798 | 6/1971 | Malamed | 160/176 X |
| 3,605,852 | 9/1971 | Vecchiarelli | 160/168 |
| 3,828,838 | 8/1974 | Anderle et al. | 160/176 |
| 3,918,513 | 11/1975 | Englund et al. | 160/176 R |
| 4,143,699 | 3/1979 | Marotto | 160/176 R |
| 4,200,135 | 4/1980 | Hennequin | 160/176 R X |

FOREIGN PATENT DOCUMENTS

| | | | |
|---|---|---|---|
| WO80/02714 | 12/1980 | PCT Int'l Appl. | 160/177 |

*Primary Examiner*—Ramon S. Britts
*Assistant Examiner*—David M. Purol
*Attorney, Agent, or Firm*—Robert K. Youtie

[57] ABSTRACT

A venetian blind which may have a conventional head rail, tilt rod, ladder tapes and slats, wherein a framework is mounted in the head rail and rotatably passes the tilt rod, an arm extends generally radially from the tilt rod for rotation with the latter, and a pair of stop members are selectively positionable relative to the framework in the path of arm movement for limiting arm rotation in opposite directions. The slats may be provided with reflective and absorptive surfaces to cooperate with the limiting positions of tilt for reflecting and absorbing heat in accordance with the seasons or other desiderata.

7 Claims, 8 Drawing Figures

VENETIAN BLIND WITH SELECTIVE TILT LIMITING

BACKGROUND OF THE INVENTION

In the field of venetian blinds it is well known to provide tilt limiting means associated with the tilt rod to stop slat tilting movement at desired limits, say to reduce ladder type wear by the slats, and for other reasons. Applicant is aware of certain such prior patents, including the following:

| U.S. Pat. No. | PATENTEE |
|---|---|
| 3,581,798 | MALAMED |
| 3,605,852 | VECCHIARELLI |
| 3,828,838 | ANDERLE ET AL. |
| 3,918,513 | ENGLUND ET AL. |
| 4,143,699 | MAROTTO |

None of the above listed prior patents suggest applicant's particular adjustability of slat tilt positions.

Applicant is aware of certain prior patents concerning heat reflection and absorption by slats or panels, such as the following:

| U.S. Pat. No. | PATENTEE |
|---|---|
| 2,596,479 | GOLDSTINE |
| 2,874,612 | LUBOSHEZ |
| 3,443,860 | LUBOSHEZ |
| 4,409,960 | BALZER |

SUMMARY OF THE INVENTION

It is an important object of the present invention to provide a venetian blind slat tilt limiting device which is extremely simple and economical in manufacture and assembly, readily adjustable to desired slat tilt limiting positions, can quickly and easily be incorporated in venetian blinds without design changes, and is simple, durable and reliable in operation throughout a long useful life.

It is another object of the present invention to provide a venetian blind slat tilt limiting device for cooperation with slats having reflective and absorptive surfaces wherein the limiting positions may be selected in accordance with the season by a simple one finger operation to convert the venetian blind to achieve maximum energy conservation for both summer and winter operation.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENTS

Figure 1:
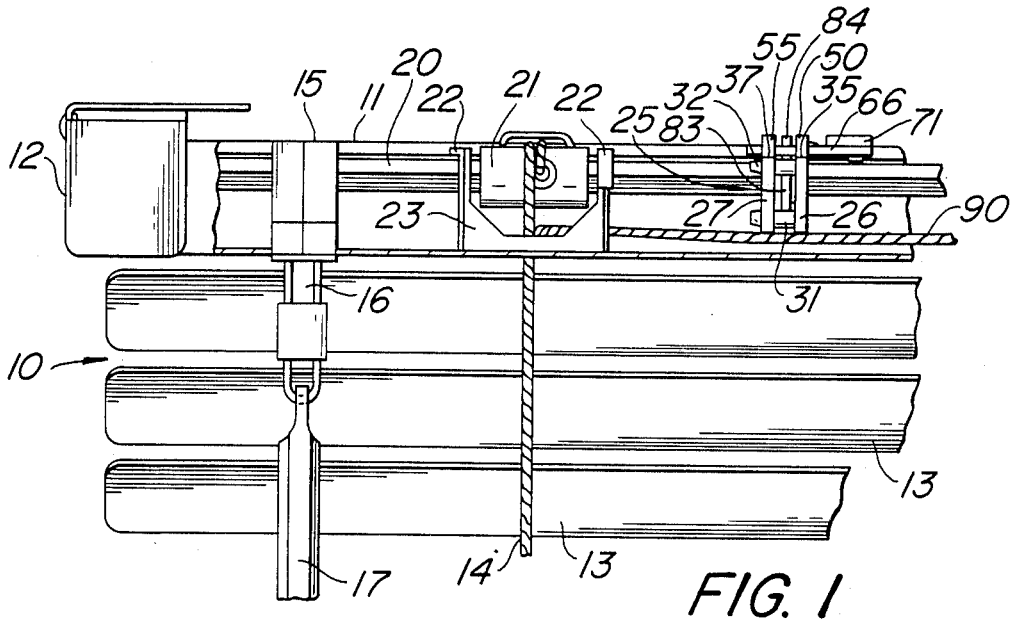
FIG. 1 is a partial elevational view showing a venetian blind construction of the present invention, with the head rail partly broken away to illustrate interiorly thereof the tilt limiting mechanism.

Referring now more particularly to the drawings, and specifically to FIG. 1 thereof, a venetian blind is generally designated 10, and includes generally a horizontal upper member or head rail 11 having its opposite ends supported by mounting brackets 12 suitably fixed to the window structure. The head rail may be a hollow structure, say an upwardly open channel, beneath which are suspended a plurality of generally horizontally extending, superposed slats 13, as by ladders 14. The head rail or channel 11 may have mounted therein a suitable tilt operating mechanism 15, say of the worm-and-wheel gear type, including an operating worm shaft 16 depending from the head rail 11 and provided with an actuating member or operating rod 17.

Extending longitudinally within the head rail 11 is a rotatably journaled tilt rod or shaft 20, preferably of noncircular cross sectional configuration, such as hexagonal. The tilt rod 20 may be rotatably supported by cradles 23 secured in the head rail 11 and having upstanding journals 22 rotatably receiving the tilt rod. A rocker or drum 21 is nonrotatably circumposed about the tilt rod 20 between the journals 22; and, the upper ends of the ladder 14 extend over and are anchored to the drum 21.

As thus far described, the construction may be essentially conventional; and, there is no limit to slat tilting movement except that by engagement of the slats with each other and the ladder material. This is undesirable as lacking control and resulting in premature wear.

However, there is provided in the head rail channel 11 a tilt limiting mechanism, generally designated 25, which limits slat tilting to a desired angular range terminating at desired inclinations.

Figure 2:
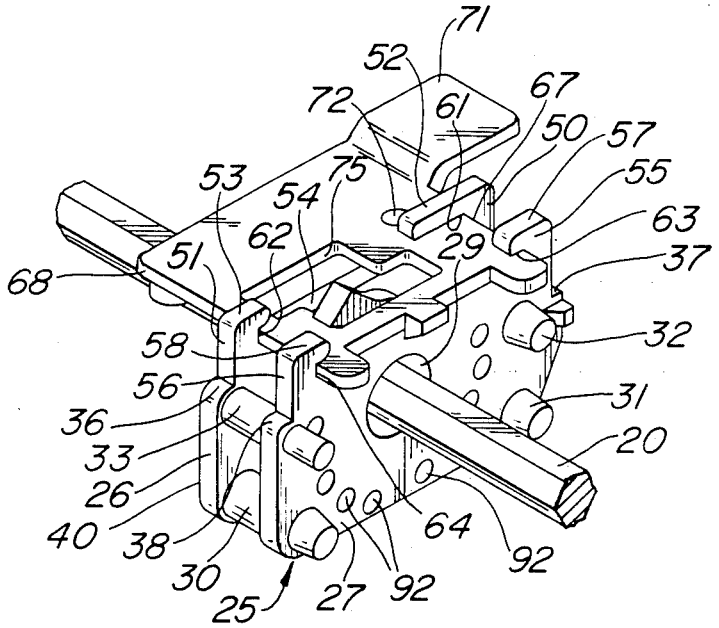
FIG. 2 is a top perspective view showing the tilt limiting mechanism of FIG. 1 and a tilt rod apart from the remainder of the venetian blind.

The tilt limiting mechanism 25 includes a pair of parallel spaced facing walls 26 and 27, which are similar in outline configuration and extend transversely across the interior of the head rail channel 11. The walls 26 and 27 each include a central through opening, as at 29 of wall 27 in FIG. 2. The tilt rod 20 extends rotatably through both of the aligned central openings 29 of the plates 26 and 27 so that the plates are supported in spaced relation over the bottom wall of head rail channel 11. The plates or walls 26 and 27 are maintained in their parallel spaced relation by a plurality of necked or shouldered and headed tie members or pins, as at 30, 31 and 32 which may extend normal to and integrally from one plate, say plate 26 for snap engagement through corresponding apertures in the other plate 27. Additionally a shouldered locating pin 33 may extend from plate 26 through a corresponding aperture in plate 27. In this manner the plates 26 and 27 are secured rigidly in their parallel spaced relation to define a staunch framework 40 for the tilt limiting mechanism. Additionally, the plate 26 may be provided on its vertical edges with upwardly facing, front and rear shoulders or edges 35 and 36; and similarly the plate 27 may be provided with front and rear upwardly facing shoulders or edges 37 and 38 respectively substantially level with shoulders 35 and 36. The plates 26 and 27 are supported on the tilt rod 20 and retained downwardly by engagement of the front shoulders 35 and 37 with the inturned lip or flange 41 of the head rail front wall 42, while being maintained downwardly by engagement of the rear shoulders 36 and 38 with the downturned lip or flange 43 of the head rail rear wall 44. Thus, the framework 40 is supported vertically and held against rotation in the head rail 11.

Upstanding from the plates 26 and 27, at the forward and rearward edges are inturned guide members or fingers. Specifically, upstanding from plate 26 are a pair of forward and rearward guide members 50 and 51 beyond their adjacent upwardly facing shoulders 35 and 36 and terminating in inturned fingers 52 and 53 spaced over the upper edge 54 of the plate 26. Similarly, the structure guide plate 27 is provided with forward and rearward members 55 and 56 upstanding adjacent to and beyond the forward and rearward shoulders 37 and 38, respectively, and terminating in inturned fingers 57 and 58 spacedly overlying the upper edge 59 of the side wall 27.

The upper side wall or plate edges 54 and 59 are substantially coplanar, and the several inturned members or guide fingers 52, 53, 57 and 58 are horizontally aligned or substantially coplanar to define with the upper plate edges generally coplanar notches or receivers 61, 62, 63 and 64, respectively associated with extensions 50, 51, 55 and 56.

The guide members 50, 51, 55 and 56, together with their inturned fingers or end portions 52, 53, 57 and 58 combine to define by the notches or receivers 61, 62, 63 and 64 a guideway or way means for a generally horizontal operating member or plate 66.

Figure 3:
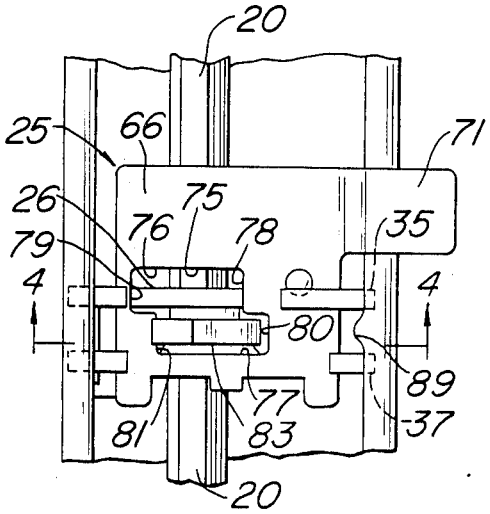
FIG. 3 is a partial top plan view of the venetian blind of FIG. 1 illustrating the tilt limiting mechanism in one position of adjustment, being the winter position in the illustrated embodiment.

The operating member or plate 66 is generally horizontally disposed with parallel front and rear edges 67 and 68, the former being slidably received in slots 61 and 63 of guide members 50 and 55, while the rear edge 68 is slidably received in the slots 62 and 64 of guide members 51 and 56. The horizontal operating member or plate 66 extends considerably beyond the vertical plate 26 of framework 40, as by extending portion 70 spaced over the head rail 11. Extending forwardly from the portion 70 of plate 66 is a finger tab or actuating member 71, which projects forwardly beyond the head rail 11 for convenient finger actuated sliding movement of the operating member or plate 66 between the operating positions shown in FIGS. 3 and 5. In FIG. 3 it will be seen the operating member or plate 66 is formed with a raised portion or detent 72 adjacent to plate edge 67 and just outboard of finger 52. Further, it will be seen that finger 52 is of greater inward extent than are similar guideway fingers 53, 57 and 58. This greater extent of finger 52 locates it across the path of movement of protuberance 72, and affords the finger a resiliency for snap engagement over the protuberance upon operating member shifting movement between the positions of fingers 3 and 5. Thus, the protuberance 72 cooperates with the finger 52 to prevent inadvertent or unintended return of operating member 66 from one operating position to the other. The protuberance 72 and adjacent finger 52 thus combine to define a resiliently yieldable holding or detent means for the operating member of plate 66.

Figure 5:
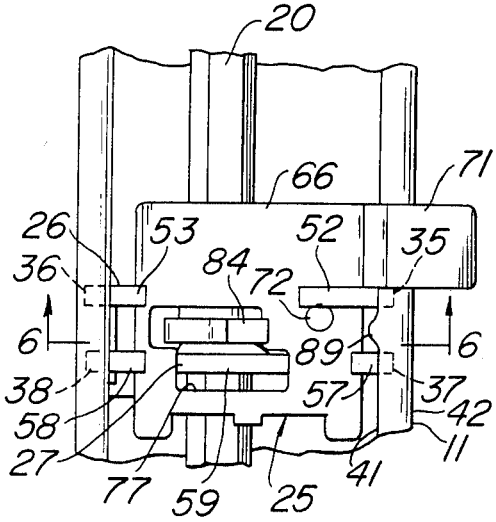
FIG. 5 is a top plan view similar to FIG. 3, but showing the tilt limiting mechanism in its other or summer position of adjustment.

The operating member or plate 66 is formed generally over the framework 40 with a cut-out or opening 75, which may be defined by a pair of generally similar rectangles in side-by-side, contiguous relation and longitudinally offset with respect to each other. The opening 75 is best seen in FIGS. 3 and 5 as including a rectangle or rectangular opening 76 adjacent to framework plate or wall 26 and contiguous to a rectangular opening 77 adjacent to framework wall or plate 27. The contiguous cut-outs or openings 76 and 77 open into each other along one longitudinal side and have their end edges offset from each other. More specifically, the front and rear end edges 78 and 79 are respectively adjacent to and offset rearwardly from the front and rear end edges 80 and 81 of the opening 77. The contiguous rectangular openings 76 and 77 are displaceable upon shifting movement of the plate 66 between the positions of FIGS. 5 and 3 to respectively overly the space between the framework walls 26 and 27.

Interposed between the framework walls 26 and 27 is a radial member or crank 83 nonrotatably circumposed about the tilt rod or shaft 20 and having an arm 84 projecting radially upwardly through the cut-out 75 of operating member 66. The radial arm 84 projects into one of the rectangular openings 76 and 77, depending upon the position to which operating member 66 is shifted. For example, with the operating member 66 shifted rightward (as seen from the front or right hand side in FIG. 3), the arm 84 projects upwardly through rectangular opening 77. In this condition the tilt rod is rotatable between limiting positions determined by abutting engagement of the arm 84 with end edge 81 (as shown in solid lines) and end edge 80 (as shown in phantom). This may be considered the winter position of adjustment of the tilt rod limiting structure 25. For example, the several slats 13, see FIG. 4, may have their upper surfaces 86 reflective, as by aluminum or other reflective coating, and may have their lower surfaces 87 absorptive, as by a dark colored coating. In the solid line limiting position of FIGS. 3 and 4, the slats 13 are generally spaced apart or open for transmitting light; while in the phantom position the slats are overlapping or closed with the absorptive side facing outwardly for absorbing radiation, an optimum wintertime condition.

Figure 4:
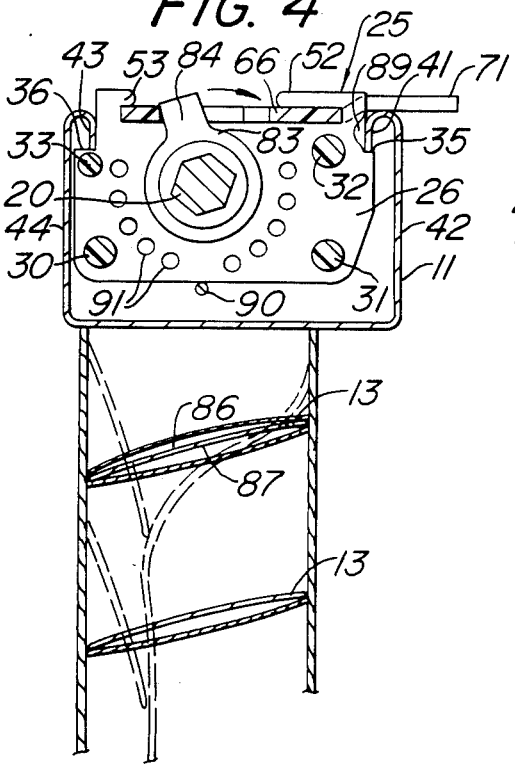
FIG. 4 is a transverse sectional elevational view taken generally along the line 4—4 of FIG. 3 showing the venetian blind of the present invention in a winter position of tilt limit adjustment, the slats being at their limiting open position in solid lines and at their limiting closed position in dashed outline.
Figure 6:
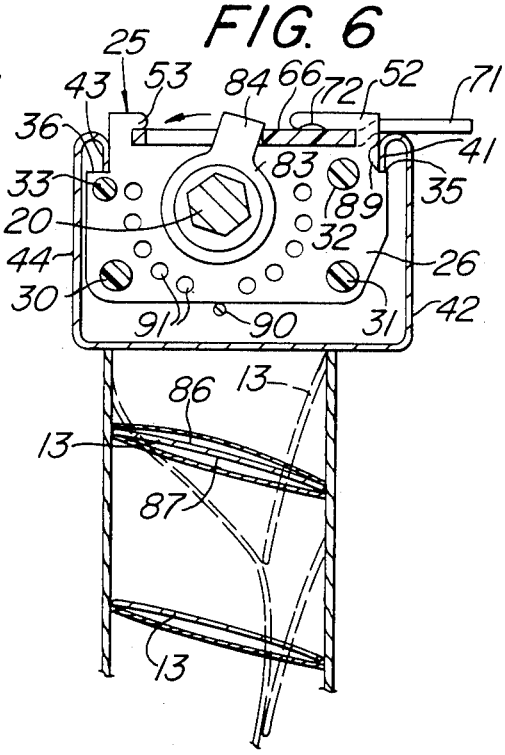
FIG. 6 is a transverse sectional elevational view taken generally along the line 6—6 of FIG. 5, the slats being shown in their limiting open position in solid lines and in closed position in dashed outline.

By manually shifting the operating member 66 from the position of FIGS. 3 and 4 to the position of FIGS. 5 and 6, the radial arm 84 is shifted into the rectangular opening 76. The tilt rod 20 is then rotatable within the limits imposed by abutting engagement of the arm 84 with the end edges 78 and 79 of the opening 76. In the solid line condition of FIGS. 5 and 6, the slats are open for transmitting radiation; and upon swinging of the tilt rod 20 to engage arm 84 with edge 79. the slats move to their phantom position with the reflective surfaces facing outwardly or reflecting radiation away. This is, of course, an optimum summertime condition to minimize air conditioning energy requirement. Further, slat positioning to exteriorly reflect heat in winter or absorb heat in summer is prevented.

In order to preclude the framework 40 from movement longitudinally of the head rail 11, the inturned flange 41 of the top rail front wall 42 may be deformed inwardly, as by the bulge 89 projecting into the space between the framework side walls 26 and 27 to prevent their movement along the head rail.

As the framework 25, particularly the side plates 26 and 27, are spaced above the bottom of the head rail 11, a lift cord 90 may extend freely along the interior of the head rail, and thence downwardly in the conventional manner for raising the venetian blind. While a wheel-and-worm tilt mechanism 15 has been illustrated and described, it is appreciated that any desired tilt operator may be employed, say a cord and pully, or other.

The framework plates 26 and 27 are each provided with a semi-circular or arcuate array of through holes, generally about and equally spaced from an axis of tilt rod 20. For example, the plate 26 may be provided with a generally semi-circular array of through holes 91 arranged about the underside of tilt rod 20; and, a similar semi-circular array of through holes 92 may be provided in the framework plate 27 about the underside of tilt rod 20 and in respective alignment with the holes 91.

If it is desired not to employ the hereinbefore described "summer/winter" adjustment feature, the operating member 66 may be omitted and the remaining structure employed to limit tilting movement of the slats to desired angular positions.

Figure 7:
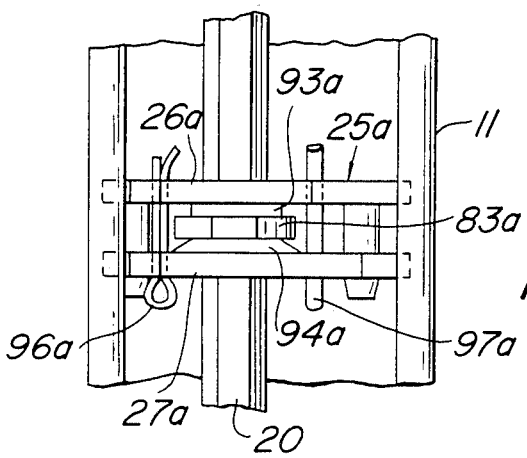
FIG. 7 is a partial top plan view showing a tilt limiting mechanism of the present invention, but of slightly modified construction.
Figure 8:
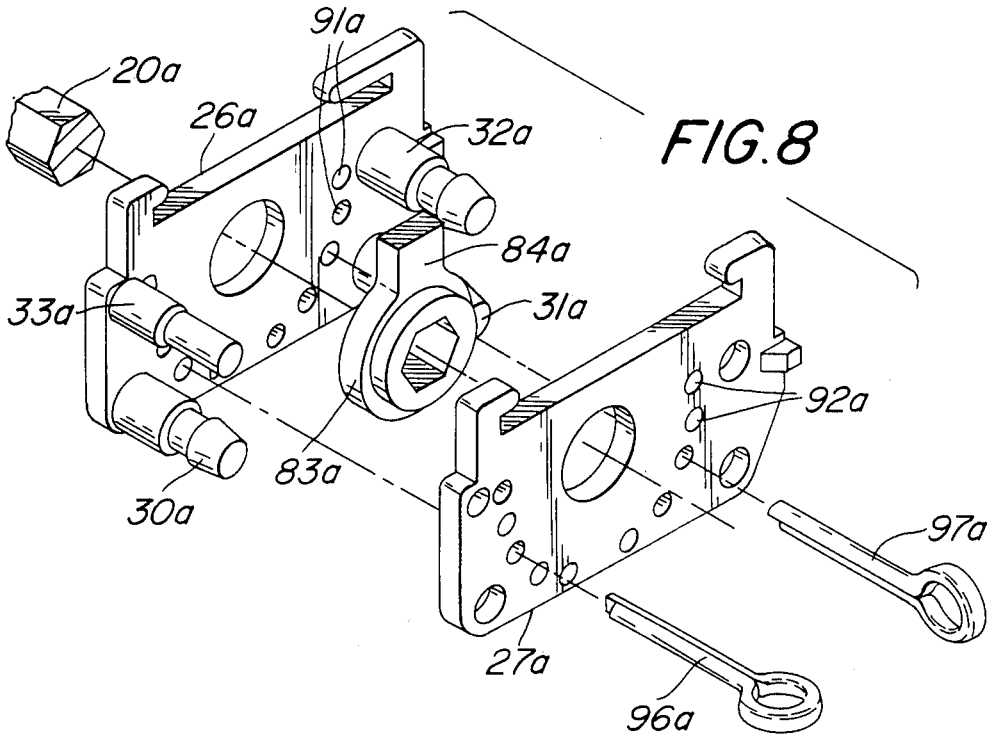
FIG. 8 is an exploded perspective view showing the tilt mechanism of FIG. 7 apart from the venetian blind head rail.

For example, see FIGS. 7 and 8, a slightly modified framework is there generally designated **25*a*, mounted in a head rail 11 and including a pair of parallel spaced walls 26*a* and 27*a* fixedly secured together by the several pins 30*a*, 31*a*, 32*a* and 33*a*, all substantially identical to the first described framework 25. A radial member or crank 83*a* is interposed between the parallel spaced walls 26*a* and 27*a* nonrotatably circumposed about the tilt rod 20*a* and including a radially extendiing arm 84*a*. The framework plates 26*a* and 27*a* may include on their facing sides lands or bosses, as at 93*a* and 94*a* to properly position and space the radial member 83*a*** between the framework walls.

In addition, a pair of stop members or pins **96*a* and 97*a* may each extend through an aligned pair of holes or apertures 91*a* and 92*a*. The pins may be cotter pins, or other suitable pins, preferably self retaining in the selected holes. By this means, the arm 84*a* is limited to rotating movement in opposite directions by abutting engagement with respective pins 96*a* and 97*a***, to thereby limit the slats to a selected pair of angular positions.

If desired, the head rail 11 may be provided with suitable indicia by way of operating instructions, as for semi-annual adjustment of the operating member 66.

From the foregoing, it is seen that the present invention provides a selective tilt limiting structure for venetian blinds which is extremely simple in construction, economical in maufacture and assembly, durable and reliable throughout a long useful life, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. In combination with a venetian blind construction including a head rail, a rotary tilt rod in said head rail, ladder tapes connected to said tilt rod for movement therewith, and slats carried by said ladder tapes and tiltable upon rotation of said tilt rod, the improvement comprising a framework mounted in said headrail and having a central through opening rotatably passing said tilt rod, an arm extending from said tilt rod for rotation therewith, a pair of stop members selectively positioned relative to said framework on opposite sides of said arm and in the path of arm movement for limiting tilt rod rotation and slat tilting, said framework comprising a pair of spaced walls extending transversely of said rail and having aligned central openings for rotatably receiving said tilt rod, said arm extending from said tilt rod in the space between said walls, and said stop members extending between and into said walls; and a control member carried by said framework and having an arm opening receiving said arm, said arm opening having a pair of opposed edges located in the path of arm movement and defining said stop members.

2. The combination according to claim 1, in combination with means mounting said control member for shifting back and forth movement relative to said framework, said arm opening having an additional pair of opposed edges offset from said first mentioned pair of opposed edges and located in the path of arm movement upon control member shifting to define an additional pair of stop members, to limit tilt rod rotation and slat tilting to positions different from that of said first mentioned pair of opposed edges.

3. In combination with a venetian blind construction including a head rail, a rotatable tile rod in said head rail, ladder tapes connected to said tilt rod for movement therewith, and slats carried by said ladder tapes to tilt upon rotation of said tilt rod, the improvement comprising: a framework mounted in said head rail and having a through central opening rotatably passing said tilt rod, an arm extending from said tilt rod for rotation therewith, a control mounted in said framework for reciprocatory movement longitudinally of said tilt rod, a pair of spaced winter stops on said control for movement with said control into the path of said arm to a winter position limiting said tilt rod to rotary movement with said slats open or absorbing external heat, and a pair of summer stops on said control for movement therewith into the path of said arm to a summer position limiting said tilt rod to rotary movement with said slats open or reflecting external heat.

4. The combination according to claim 3, said control being shiftable relative to said framework between said winter and summer positions and having a pair of offset openings communicating with each other and selectively receiving said arm in said positions, said openings each having opposed edges offset from each other and defining said stops.

5. The combination according to claim 4, said framework comprising a pair of facing spaced walls fixed in said rail transversely thereof and having aligned openings receiving said tilt rod, and way means extending upwardly from said walls and providing a guide way extending longitudinally of said rail, said control being mounted in said guide way for said shifting movement.

6. The combination according to claim 5, said control comprising a plate shiftable in said guide way, and an actuating member extending from said plate exteriorly of said rail for manually shifting said plate.

7. The combination according to claim 3, said slats being radiation absorbent on one face for absorbing external heat and being radiation reflective on the other face for reflecting external heat.

* * * * *